US006923445B2

(12) United States Patent
Such

(10) Patent No.: US 6,923,445 B2
(45) Date of Patent: Aug. 2, 2005

(54) GAMING TICKET SETS HAVING ADVERTISING BY MULTIPLE ADVERTISERS WITH SELECTABLE VARIABLE ADVERTISER EXPOSURE FREQUENCY

(76) Inventor: David A. Such, 801 River Dr. South, P.O. Box 2589, Great Falls, MT (US) 59403-2589

( * ) Notice: Subject to any disclaimer, the term of this patent is extended or adjusted under 35 U.S.C. 154(b) by 0 days.

(21) Appl. No.: 10/651,486

(22) Filed: Aug. 29, 2003

(65) Prior Publication Data

US 2004/0108653 A1 Jun. 10, 2004

Related U.S. Application Data

(60) Provisional application No. 60/407,595, filed on Aug. 30, 2002.

(51) Int. Cl.[7] ..... A63F 3/06
(52) U.S. Cl. ..... 273/269; 283/903
(58) Field of Search ..... 273/138.1, 139, 273/269; 283/901, 903

(56) References Cited

U.S. PATENT DOCUMENTS 3,696,745 A * 10/1972 Morton ..... 101/415.1
4,619,457 A * 10/1986 Small ..... 273/269
4,962,950 A * 10/1990 Champion ..... 283/67
5,738,351 A * 4/1998 Booth ..... 273/139
5,921,547 A * 7/1999 Wilner ..... 273/139
6,017,032 A * 1/2000 Grippo et al. ..... 273/138.1
6,044,135 A * 3/2000 Katz ..... 379/93.13
6,296,250 B1 * 10/2001 Langan ..... 273/139
6,578,735 B1 * 6/2003 Mothwurf ..... 221/255
6,663,105 B1 * 12/2003 Sullivan et al. ..... 273/138.2

* cited by examiner

*Primary Examiner*—Kurt Fernstrom
(74) *Attorney, Agent, or Firm*—Gregory I.P. Law; Randy A. Gregory

(57) ABSTRACT

Apparatus, systems and methods involving producing and distributing chance tickets, such as pull-tab tickets, scratch-off tickets, and folded tickets which have symbol sets used to determine whether the ticket has a winning symbol set or sets versus non-winning symbol set or sets. The chance tickets are produced in sets which have advertising sections thereon which vary from ticket to ticket. The advertiser placing the advertising section on the tickets can choose the specific frequency of advertiser's message and the frequency may vary from advertiser to advertiser within a set. Also described are groups of chance tickets that each include at least one set of chance tickets. The advertising on chance tickets within one group vary from those of another group depending on the area of distribution.

12 Claims, 9 Drawing Sheets

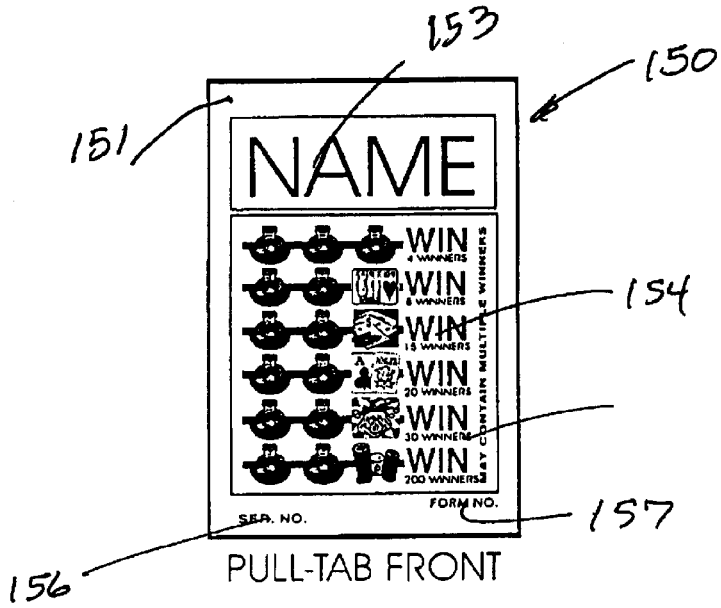
Figure 12
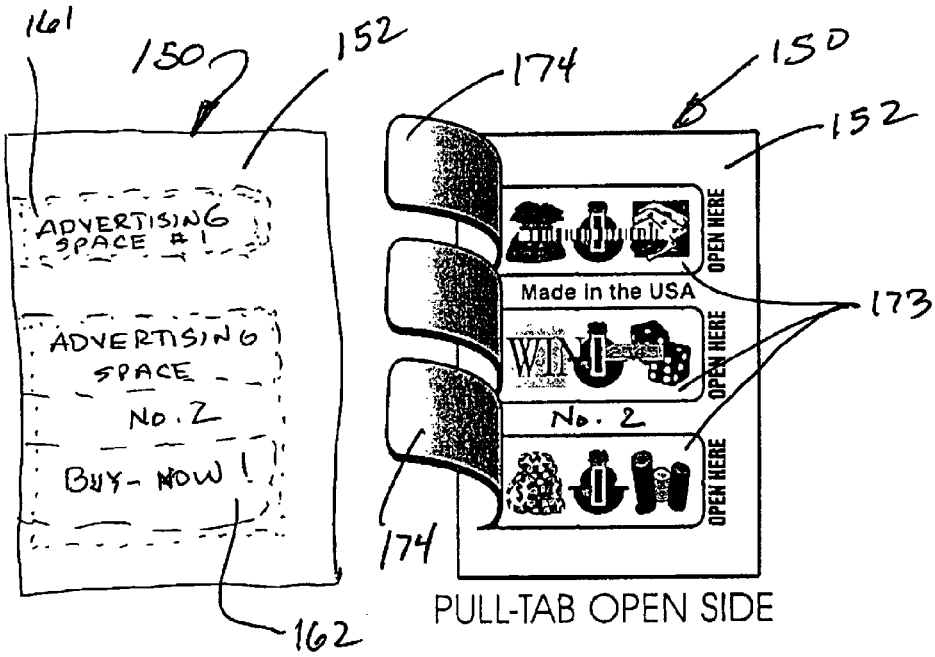
Fig. 13A
Figure 13B

GAMING TICKET SETS HAVING ADVERTISING BY MULTIPLE ADVERTISERS WITH SELECTABLE VARIABLE ADVERTISER EXPOSURE FREQUENCY

CROSS-REFERENCE TO RELATED APPLICATIONS

This application claims priority under 35 U.S.C. §120 based upon U.S. Provisional Patent Application Ser. No. 60/407,595 filed Aug. 30, 2002.

TECHNICAL FIELD

The invention relates to methods, apparatus, assemblies and systems for providing promotional advertising space on pull-tabs, scratch-off tickets, break-open folded tickets and similar gaming tickets.

BACKGROUND OF THE INVENTION

Games of chance have always been of attraction and entertainment value. For many years chance tickets have been produced in various forms. One common form of chance ticket is commonly known as a pull-tab. A pull-tab has one or more reveal areas which can be peeled or otherwise opened to reveal a symbol set. The symbol set may have one or more symbols. The symbol set may be a winning symbol set or a non-winning symbol set.

Other chance tickets include scratch-off tickets or "scratch-offs". Scratch-off chance tickets have one or more symbol sets that are revealed by scratching off a coating that is usually opaque and prevents viewing by the end user.

Another type of chance ticket is folded tickets. The folded tickets are typically soft and opened after removing a seal or band. The end user cannot see the symbol set or sets provided on the chance ticket because of the folded configuration.

Chance tickets are frequently regulated by statute. In some jurisdictions they cannot be sold. In others there are various requirements. In general, chance tickets can be sold only in states permitting the legal sale of these products. The types of chance ticket products which can be sold may vary by jurisdiction.

Regulations also often control the licensing of manufacturers, distributors, taverns, bingo halls, and fraternal clubs which may utilize or distribute chance tickets.

Pull-tab tickets often display a menu of cash prizes, which are won by the players holding a combination of symbols that match the winning symbol sets indicated in the menu determining a winning game piece or ticket. The menu describing the winning from non-winning symbol sets is usually included on either the front or back of the ticket. Typically the pull-tabs, scratch-offs or soft folded tickets are sold for a dollar amount such as $1.00, $0.50, or $0.25.

Presently, there are twenty-six states that issue a license to manufacturers and distributors to sell pull-tabs, scratch-offs or soft folded tickets to licensed taverns, bingo halls and fraternal clubs, which in turn sell this product to the general public. The licensed taverns, bingo halls and fraternal clubs sell pull-tabs, scratch-offs or soft folded tickets to make a predetermined profit associated with the sale of a predetermined number of chance tickets that make up a ticket set. After selling all the pull-tabs, scratch-offs or soft folded tickets in the entire game or ticket set, then the predetermined maximum profit can be realized. If the entire set is not sold, then the profit will diminish. If the ticket set is distributed with the distributor bearing risk of paying part or all of the winnings, then profit depends on which tickets are sold and redeemed for prize earnings.

In some areas the licensed distribution of chance tickets to taverns, bingo halls, and fraternal clubs may be associated with either a charitable organization or represent a charity or charitable organization. This may be due to custom or law.

Pull-tabs and scratch-offs are also used in some state lottery games. Scratch-off games are primarily used in state lottery games and typically sold for $1.00 per game piece.

Scratch-off games are also widely used as promotional games in fast food or retail businesses. In these instances the game pieces are distributed to the general public without charge.

Chance ticket games in the past have been used and are still used by a limited number of individual bingo halls and fraternal clubs which often have large volumes of usage. Some have been printed to advertise their individual bingo games or clubs' information on one side of the tickets.

Chance ticket games have also been used as a vehicle to offer discount coupons on various products or services. Chance tickets used in this fashion are frequently not sold as a gambling device, but instead, are given as a complementary item. The winning tickets are usually associated with small prizes.

Chance tickets have also been sold for value and been provided with an associated coupon or special offer. Such are used in the commercial promotional marketplace. These tickets display a menu of cash prizes to be won on one side, just as the gambling pull-tabs, scratch-offs or soft folded tickets used in the gambling marketplace. These pull-tabs, scratch-offs or soft folded tickets are then sold to the general public as advertising coupons in some or all states.

Chance tickets also have legitimate use in the general business world as promotional games to build in-store traffic, promote products, or as business or product sweepstake games. However, the pull-tabs, scratch-offs or soft folded tickets are not sold, but distributed "free" to the general public. Pull-tabs, scratch-offs or soft folded ticket games are also used in all types of businesses as employee incentives to improve the overall bottom line and performance of the company.

SUMMARY OF SOME EMBODIMENTS

Our invention includes versions which may introduce chance tickets such as pull-tabs, scratch-offs or soft folded ticket gaming pieces as a vehicle for all types of general advertising by any type of business or organization for all types of services and products.

Our invention involves chance tickets sold in game sets which involve the sale of advertising space. Rates for such advertising space may be charged based on the circulation exposure desired by the advertiser. The advertising would be custom fit to each business, organization or institution acting as an advertiser.

A further extension of the invention places all advertisers in a web-based mall to provide further benefits to the advertiser for an advertisement feature having web-based mall advertising connection.

The advertising space rate would be charged based on the circulation exposure desired and this may vary in frequency within a game ticket set to accommodate the desires of each advertiser.

Advertisers will be able to advertise nationally or regionally wherever our charitable gambling games are being sold.

Typical chance ticket game sets consist of 150 to 12,000 individual game pieces or tickets. Thus, the advertisers additionally have the opportunity to select the frequency or ratio their message can be presented to the public within the game unit as well as selecting a game with ticket sets that provide different numbers of tickets.

The invention offers more flexibility than traditional advertising opportunities and at far less cost. In some forms, the invention automatically guarantees a more focused, less distracting method of conveying the advertisers' message compared to other common forms of advertising, such as newspapers or magazines. The advertiser's message will have more impact because of the subtle recreational type environment. In addition, the production methods may include producing the chance ticket sets using a program which provides a complete turnkey advertising program.

Depending on the game set and program, various methods of tracking the results of the advertisers' message or messages may be possible. Thus, the invention offers small business with a meager advertising budget an opportunity to have advertising exposure and possible effectiveness feedback enjoyed previously by only those advertisers with large budgets.

Additionally, advertisers using this program may have the opportunity to: (1) advertise on a web-based mall; (2) advertisers would be included in a promotional game web site; (3) access to a "pin number" registry for both web and telephone dial-in; (4) advertising would be tied to in-store pull-tabs, scratch-offs or soft folded ticket games; (5) advertisers would participate in a national grand prize; (6) advertisers can partake in a variety of kiosk programs; (7) participate in a unique co-op media campaign.

BRIEF DESCRIPTION OF THE DRAWINGS

Preferred embodiments of the invention are described below with reference to the following accompanying drawings.

FIG. 12 shows the front side of a pull-tab according to another embodiment of the invention.

FIG. 13A shows the rear or reverse opening side of the pull-tab of FIG. 12 with the reveal areas intact in a closed or unopened condition.

FIG. 13B shows the opening side of the pull-tab shown in FIGS. 12 and 13A with the reveal areas opened into an opened condition.

DETAILED DESCRIPTION OF THE PREFERRED EMBODIMENTS

Introductory Note

The readers of this document should understand that the embodiments described herein may rely on terminology used in any section of this document and other terms readily apparent from the drawings and language common therefor. This document is premised upon using one or more terms with one embodiment that will in general apply to other embodiments for similar structures, functions, features and aspects of the invention. Wording used in the claims is also descriptive of the invention. Terminology used with one, some or all embodiments may be used for describing and defining the technology and exclusive rights associated herewith.

Figure 1:
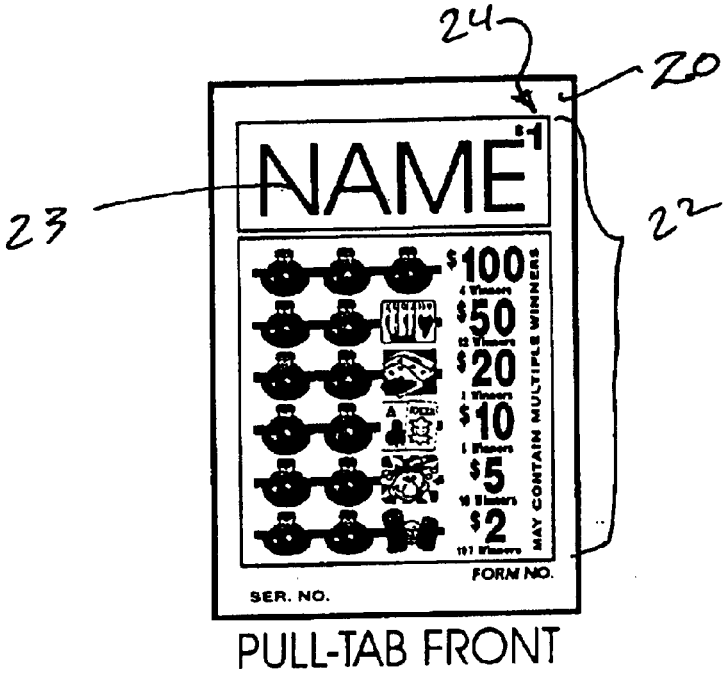
FIG. 1 shows pull-tab front side.
Figure 2:
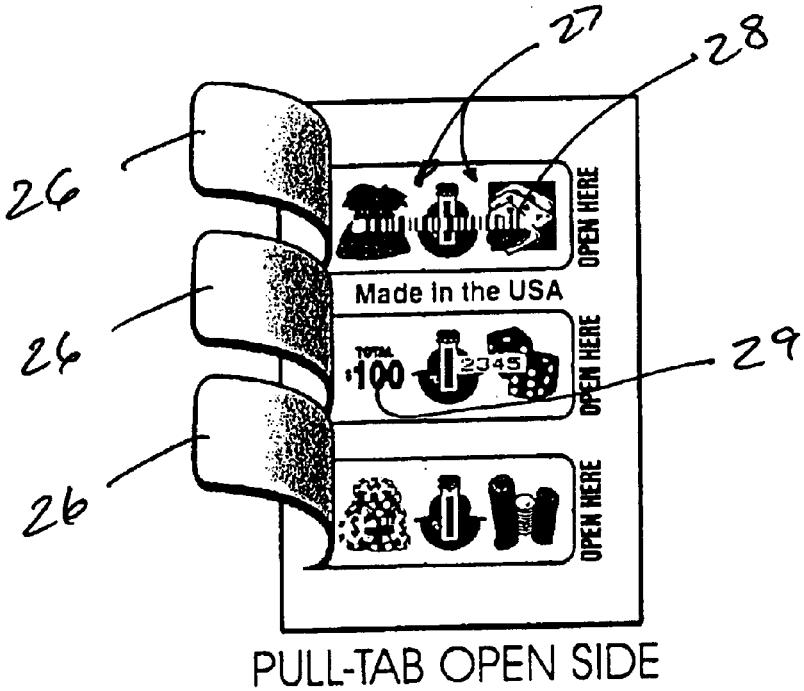
FIG. 2 shows the back or opened side of the pull-tab of FIG. 1.

Referring now to FIGS. 1 and 2, there is shown a pull-tab chance ticket 20 having a front side 21 that includes a menu or schedule 22. The menu or schedule may include a game name 23 and a chance ticket price 24.

Pull-tab 20 has a laminated upper and lower layers of material such that until torn apart by removing a tab 26, the indicia 27 do not show. Shown indicia may include various symbols, such as picture symbols 28 or numbers 29. Alternatively, the indicia may be provided as a blank devoid of symbols, or particular colors or other indicators of a winning versus non-winning condition of the symbol set behind each window or reveal area. Pull-tab 20 represents a prior art or conventional pull-tab.

Figure 3:
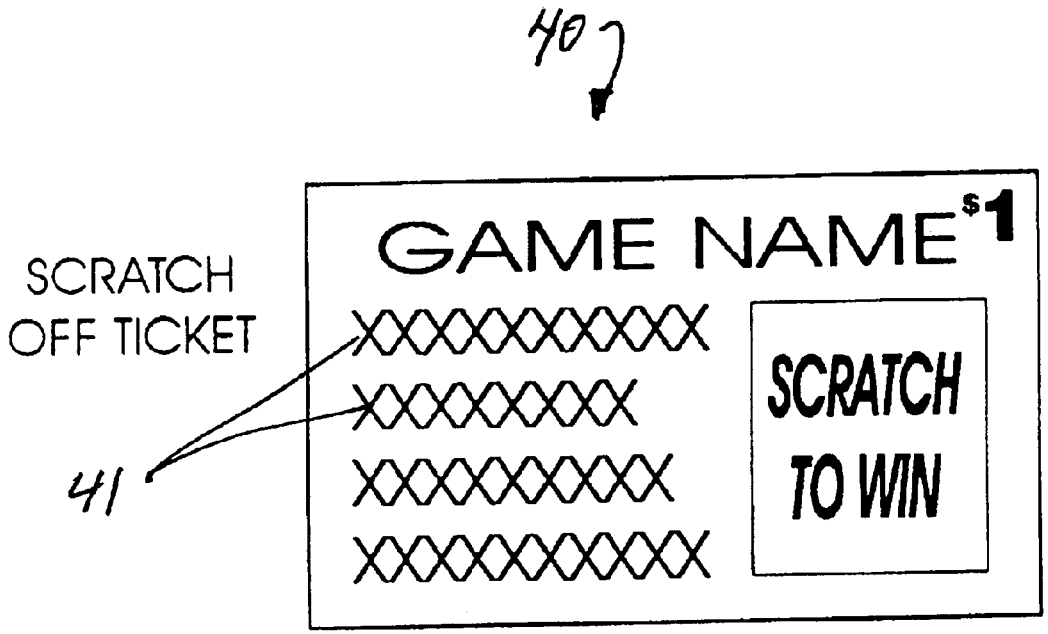
FIG. 3 shows the front side of a scratch-off chance ticket.

FIG. 3 shows a prior art or conventional scratch-off chance ticket 40. Scratch-off 40 has coating areas 41 which cover reveal areas having the game symbols or indicia (not shown in FIG. 3). The coating layers are removed by scratching to reveal the indicia. Otherwise, the reveal areas remain concealed until removed by the end user.

Figure 4:
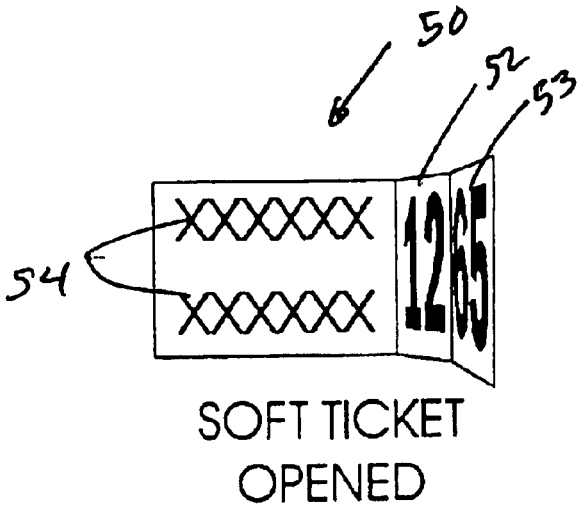
FIG. 4 shows an opened soft folded chance ticket.
Figure 5:
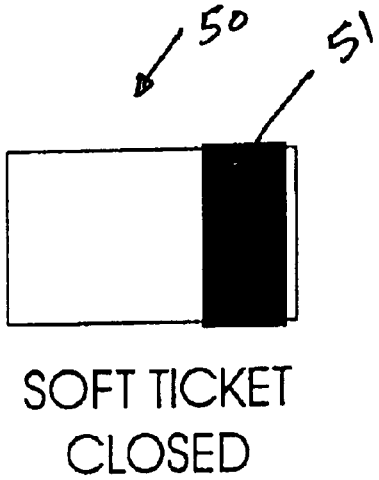
FIG. 5 shows the folded chance ticket of FIG. 4 in the closed condition.

FIGS. 4 and 5 show a conventional or prior art soft folded ticket 50. The soft folded ticket uses a wrapper or band which secures the ticket in a closed condition for distribution. The band is broken and the ticket unfolded to reveal and make the game indicia visible, as shown in FIG. 4.

As shown, the indicia includes a number set 52, 53. The indicia number set is used to identify the number or numbers used to determine a winning condition from non-winning condition, such as by matching hidden numbers covered by coating layers 54.

The pull-tabs, scratch-offs, soft folded tickets or other chance tickets may be of any suitable size or shape. Preferably they are made for handling by humans.

Figure 6:
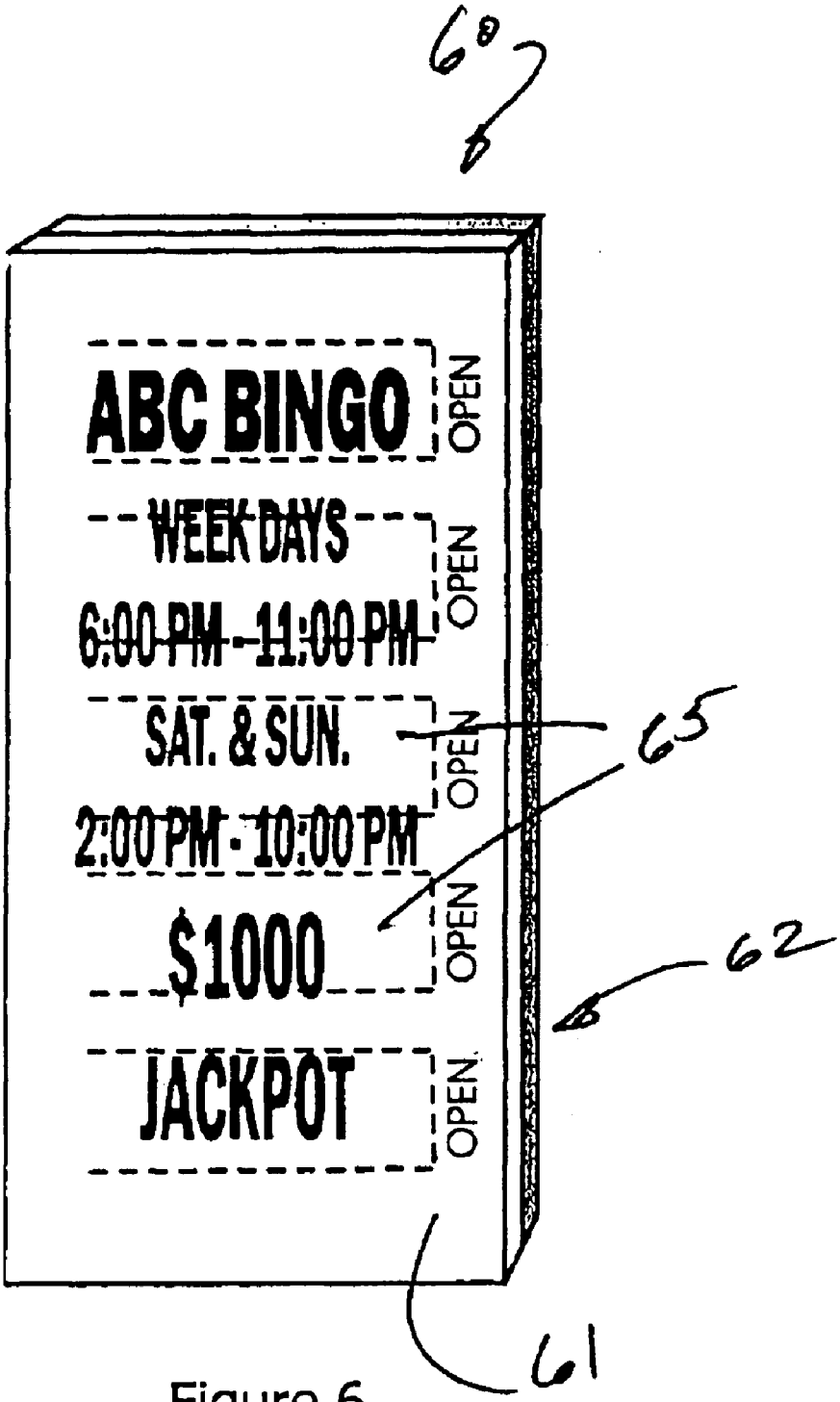
FIG. 6 is a perspective view showing a five window pull-tab chance ticket.

FIG. 6 shows a pull-tab ticket 60 in perspective from the opening side 61. The front side 62 has a front side similar to that shown in FIG. 1. The opening or rear side 61 is provided with five reveal areas 65 which may be peeled or otherwise opened as indicated in FIG. 2.

FIG. 6 shows a conventional or prior art design having a message 66, such as advertising a bingo parlor. All tickets in a ticket set or group of ticket sets were provided with similar advertising.

Figure 7:
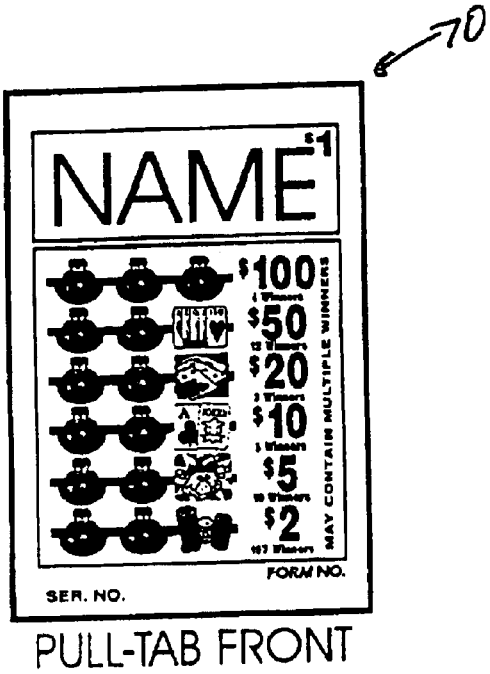
FIG. 7 is a front view of a pull-tab having a purchase price.
Figure 8:
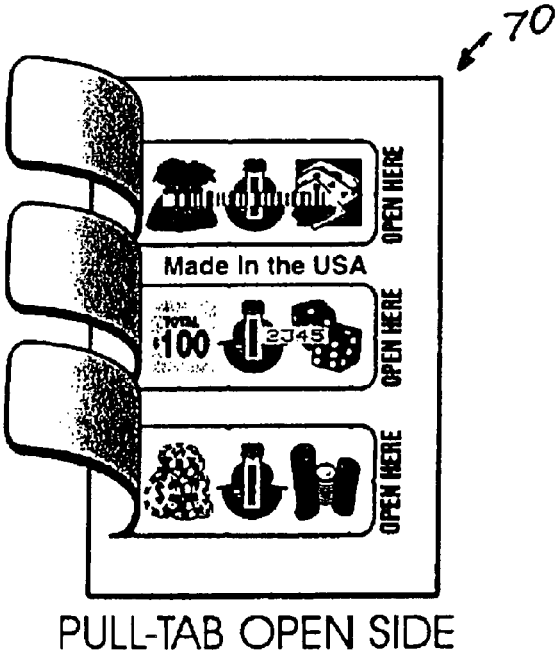
FIG. 8 is a rear view of the pull-tab of FIG. 7 with revealed areas open and three symbol sets shown, each having multiple symbols.
Figure 9:
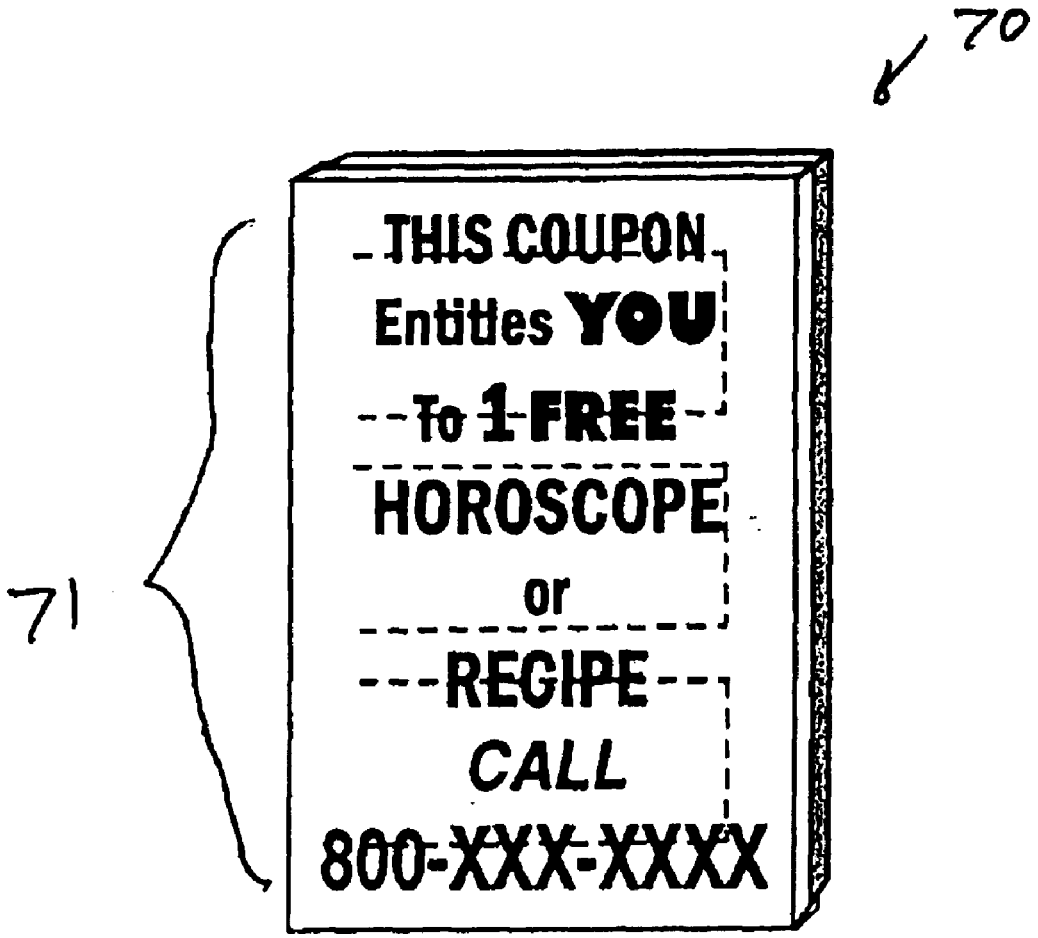
FIG. 9 is a perspective view showing another form of pull-tab.

FIGS. 7, 8 and 9 show another prior art pull-tab 70 having features similar to those described above. The opening side is provided with an advertisement 71 which is the same for all tickets in a ticket set, game or group of ticket sets. The advertising in this pull-tab comprises a coupon which entitles the holder to some free offering.

Figure 10:
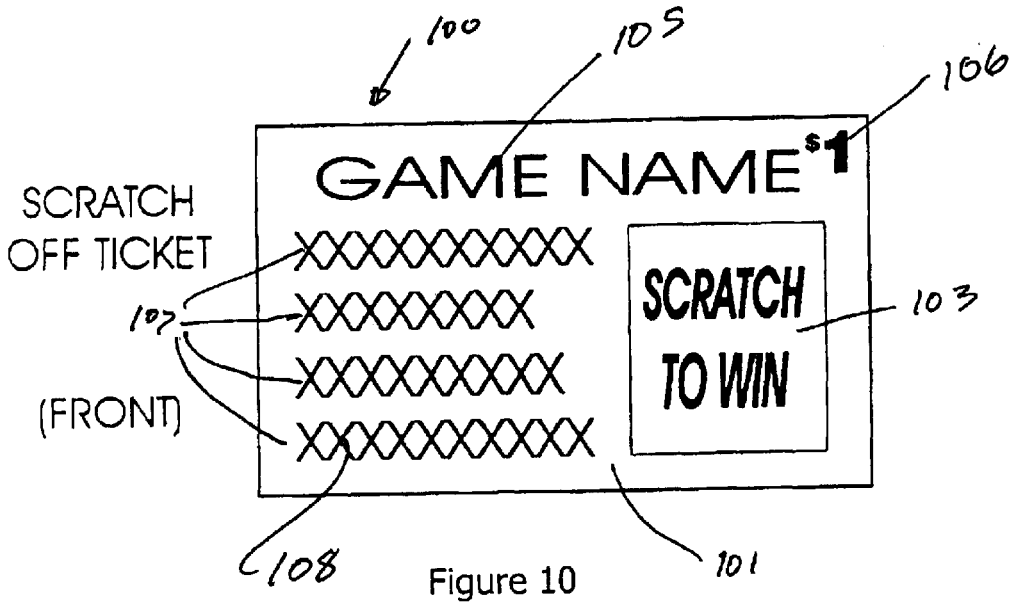
FIG. 10 shows the front side of one preferred scratch-off chance ticket according to the invention.
Figure 11:
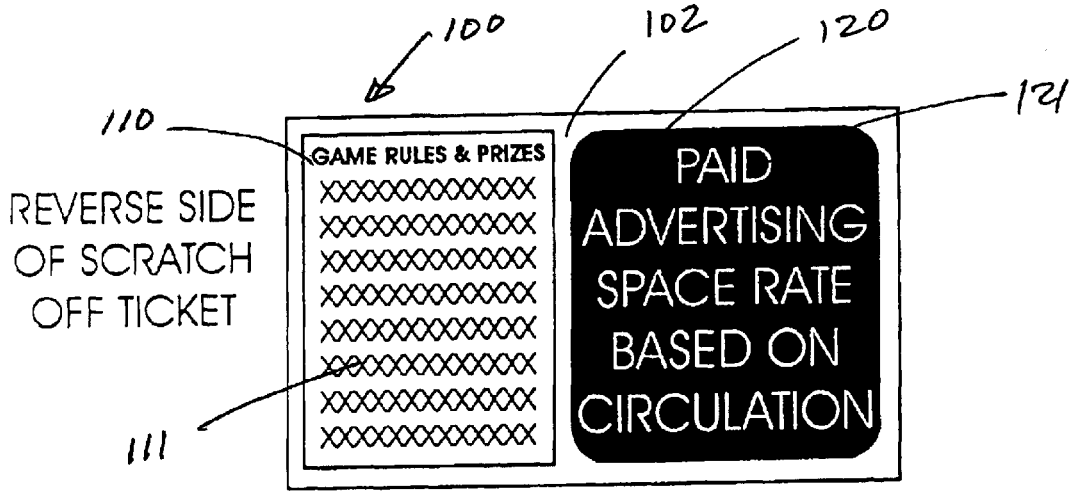
FIG. 11 shows the rear or reverse side of the chance ticket of FIG. 10.

FIGS. 10 and 11 show a scratch-off chance ticket 100 according to the invention. Ticket 100 has a front face or side 101 shown in FIG. 10 and a rear face or side 102 shown in FIG. 11.

The front side includes a trademark section 103 used to identify the producer of the game and ticket. The front side may also include a game name identifier 105 to indicate to the user what type of scratch-off game is being offered or played. A price indicator 106 is further included where the game being played uses tickets for which a purchase price or coupon charge is being made.

The front side 101 also includes at least one symbol set area 107. As shown, the ticket 100 includes four symbol set areas. The symbol set areas are provided with overlaying coatings or layers 108 that hide the symbol sets from view during distribution and until the user plays the game by scratching off the coatings 108.

FIG. 11 shows the reverse or back side 102. Back side 102 includes a rules section 110. The rules section 110 may also be provided with the winning symbols set information 111. The text of the rules and winning symbol sets is diagrammatically depicted by X's in FIG. 11.

FIG. 11 also shows a paid advertising space 120. The paid advertising space or area 120 carries a message 121 which can be according to the desires or design of the advertiser paying for the advertising space.

In accordance with the invention the ticket 100 is part of a ticket set having a plurality of tickets included therein. Typical sizes for the ticket sets are 500–12,000 chance tickets per ticket set. The ticket set according to the invention do not contain the same advertising message 121 for all tickets of the ticket set as is the case with prior art technology. Instead, it includes advertising messages from a plurality of advertisers. The advertisers may include various messages which are different. The messages may appear in different frequencies or amounts of tickets per ticket set as desired by the advertiser or offered by the producer of the tickets. This allows the advertising costs to be matched with the amount the advertiser wants to spend and be integrated into a matrix of advertisers who participate in the ticket set to the degree desired.

Additionally, the invention can include groups of ticket sets that are tailored to the geographic area or marketing area to which they are best distributed. For example, an advertiser may choose tickets which are to be distributed in specific cities, states, nations, or other geographical area. The areas may be continuous or discontinuous. The advertiser may choose or otherwise participate in distribution of tickets according to market areas, such as to gasoline stations, grocery stores, or other market defined segments that appeal to the advertisers. They can also participate to the extent and degree desired with one or multiple advertising messages included in a set or group of sets. A game may include a single set or group of sets.

FIGS. 12, 13A and 13B show a preferred pull-tab 150 according to another embodiment of this invention. Pull-tab 150 includes a front face or side 151 and rear or opening side 152.

FIG. 12 shows the front side 151. Front side 151 is provided with a game name section 153 which indicates the name or other indicia by which the distributor and end user may identify the game being offered or played. As shown, front side 151 also includes a winning symbol set schedule 154 that includes a plurality of winning symbol sets. As shown each symbol set is comprised of multiple symbols, but may have a single symbol or indicia to indicate the winning versus non-winning tickets and symbol set areas.

FIG. 12 further shows that the chance ticket 150 has on front face 151 a serial number indicia 156 which is used to identify the ticket set. Alternatively, the serial number indicia may uniquely identify each ticket. Furthermore, the serial number indicia may provide information indicating both the ticket set and uniquely identify each ticket.

FIG. 12 also shows a form number indicia 157 that may be used to indicate the particular form of the game being played. This may also be used as a group identifier which applies to a single or multiple ticket sets. The ticket also preferably includes an indication of how many winners there are for each type of winning symbol sets. The prizes or awards made will typically vary depending upon the particular features of the winning symbol set.

FIG. 13A shows the opening side or face 152. Opening side 152 is provided with one or more advertising areas. As shown, side 152 is provided with advertising area or space number one 161 and advertising space number two 162. Advertising space 161 is of different size than space 162 to provide added flexibility for meeting the demand and budget limitations of advertisers seeking advertising on chance tickets according to this invention.

FIG. 13B shows in greater clarity that the opening side has three symbol set areas 173 which are covered by tabs 174. Tabs 174 are peeled or otherwise opened by the end user. The symbol sets may include a single symbol or multiple symbols that match or otherwise combine to provide greater combinations for determining the odds of winning versus not winning.

The advertising spaces 161 and 162 may be paid for by the same or a different advertiser. More flexibly, various tickets within a ticket set may be paid for by multiple advertisers who have a similar or dissimilar frequency of appearance of the advertiser's desired message or messages.

Figure 14:
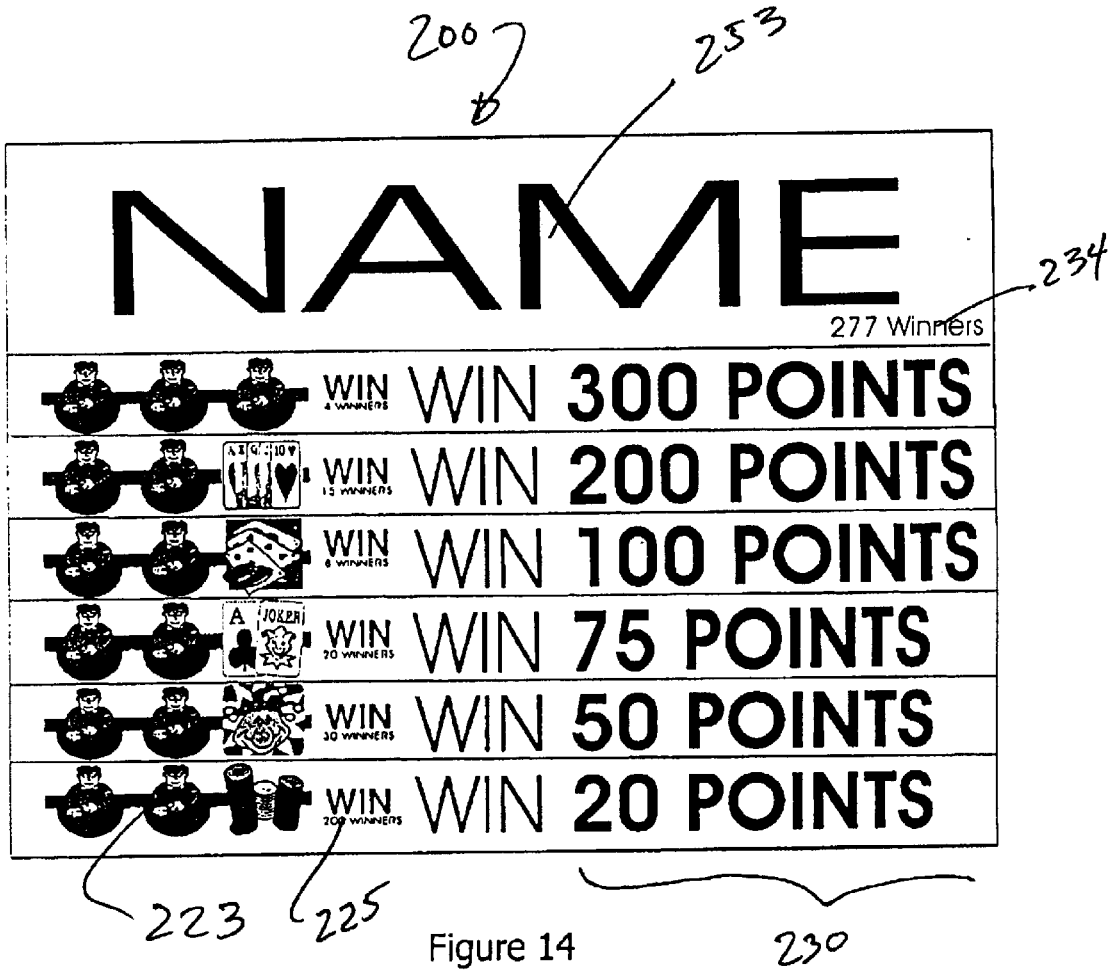

FIG. 14 describes an attraction and explanation poster 200 which announces and advertises the game being offered and played. It is usually placed in vicinity to where the chance tickets are being sold. It may also serve to compliment employee or in-store reward programs advertised via the invention. The poster also depicts the total number of winners contained in the ticket game set and the individual number of winners based on each tier contained in the ticket game set.

As shown, the poster 200 includes a game name section 253 used to indicate the game. Winning symbol sets are indicated in the menu or winning definition area 223. Winning frequencies of any particular winning symbol set may be indicated by winning symbol frequency indicators 225. Poster 200 also includes a point indication column 230 which may include points associated with particular winning symbol sets. These points may be used for various secondary games or in a fashion which earns awards or credits toward prizes, merchandise or monetary awards. A total is number of winners indicator 234 may be included to indicate the total number of symbol sets which are winning symbol sets from the total number of tickets included in a set or game.

Methods

Methods according to the invention include methods for producing chance tickets. The methods include selling advertising space for a ticket or multiple tickets comprising part of a set of chance tickets. The number or frequency of advertising messages purchased or otherwise allocated in the production of the ticket set may be adjusted as desired by the particular advertiser. Thus the advertiser may select any number of messages from the total number of advertising messages available for a particular set of tickets.

The methods further include involving and selling advertising to multiple advertisers in the production of a ticket set. This allows multiple advertisers to participate, yet reduces costs compared to the purchase of advertising for an entire set of tickets.

The set of tickets are produced by producing each ticket with a potentially different and variable advertising messages from multiple advertisers. The frequency may vary dependent upon the total chance tickets per set.

Methods according hereto may also include producing groups of tickets which may comprise a game or multiple games wherein the set or sets of tickets of the group have different advertisers or be directed at different market areas.

Further Aspects

An apparatus forming a set of chance tickets, comprising:

wherein said set of chance tickets including a plurality of chance tickets each chance ticket having at least one symbol set which is hidden when distributed by a distributor and then opened by an end user to reveal the at least one symbol set, said at least one symbol set including at least one symbol that is indicative of a winning condition or a non-winning condition of the symbol set; said set of chance tickets including individual chance tickets a majority of which include at least one advertising section thereon;

said at least one advertising section on multiple chance tickets of said set of chance tickets being different from other chance tickets of the same set so as to provide advertisements for a plurality of different advertisers which may vary from chance ticket to chance ticket at an advertisement frequency specific to each advertiser.

An invention as indicated in the prior paragraph wherein the advertisement frequency of advertisements for each advertiser is variable by advertiser.

A system forming multiple groups of chance tickets, each group of chance tickets including at least one set of chance tickets, comprising:

wherein said set of chance tickets including a plurality of chance tickets each chance ticket having at least one symbol set which is hidden when distributed by a distributor and then opened by an end user to reveal the at least one symbol set, said at least one symbol set including at least one symbol that is indicative of a winning condition or a non-winning condition of the symbol set; said set of chance tickets including individual chance tickets a majority of which include at least one advertising section thereon;

said at least one advertising section on multiple chance tickets of said set of chance tickets being different from other chance tickets of the same set so as to provide advertisements for a plurality of different advertisers which may vary from chance ticket to chance ticket at an advertisement frequency specific to each advertiser; and wherein at least two groups of chance tickets are adapted to provide advertising which is different by geographical area of ticket distribution.

An invention as indicated in the prior paragraph wherein the advertisement frequency of advertisements for each advertiser is variable by advertiser.

A method for producing chance tickets comprising: taking advertising orders from multiple advertisers who desire to have advertising sections included on chance tickets which form a set of chance tickets; said set of chance tickets including a plurality of chance tickets each chance ticket having at least one symbol set which is hidden when distributed by a distributor and then opened by an end user to reveal the at least one symbol set, said at least one symbol set including at least one symbol that is indicative of a winning condition or a non-winning condition of the symbol set; producing said set of chance tickets with advertising sections on individual chance tickets which vary from ticket to ticket with different advertisements from different advertisers.

A method according to the prior paragraph wherein said producing includes having the frequency of advertisements be variable by advertiser.

Interpretation Note

The invention has been described in language directed to the current embodiments shown and described with regard to various structural and methodological features. The scope of protection as defined by the claims is not intended to be necessarily limited to the specific features shown and described because other forms and equivalents for implementing the invention can be made and in some cases this is done simple to evade the intended purpose of this document and any exclusive rights associated therewith.

I claim:

1. An apparatus forming a set of chance tickets, comprising:

wherein said set of chance tickets includes a plurality of chance tickets, each chance ticket having at least one symbol set which is hidden when distributed by a distributor and then opened by an end user to reveal the at least one symbol set, said at least one symbol set including at least one symbol that is indicative of a winning condition or a non-winning condition of the symbol set;

said set of chance tickets including individual chance tickets a majority of which include at least one advertising section thereon;

said at least one advertising section on multiple chance tickets of said set of chance tickets being different from other chance tickets of the same set so as to provide advertisements for a plurality of different advertisers which vary between chance tickets at an advertisement frequency specific to each advertiser.

2. An apparatus according to claim 1 and wherein the advertisement frequency of advertisements for each advertiser is variable by advertiser.

3. A system forming multiple groups of chance tickets, each group of chance tickets including at least one set of chance tickets, comprising:

wherein said set of chance tickets includes a plurality of chance tickets, each chance ticket having at least one symbol set which is hidden when distributed by a distributor and then opened by an end user to reveal the at least one symbol set, said at least one symbol set including at least one symbol that is indicative of a winning condition or a non-winning condition of the symbol set;

said set of chance tickets including individual chance tickets a majority of which include at least one advertising section thereon;

said at least one advertising section on multiple chance tickets of said set of chance tickets being different from other chance tickets of the same set so as to provide advertisements for a plurality of different advertisers which vary between chance tickets at an advertisement frequency specific to each advertiser;

and wherein at least two groups of chance tickets are adapted to provide advertising which is different by geographical area of ticket distribution.

4. An apparatus according to claim 3 and wherein the advertisement frequency of advertisements for each advertiser is variable by advertiser.

5. A method for producing chance tickets comprising:

taking advertising orders from multiple advertisers who desire to have advertising sections included on chance tickets which form a set of chance tickets;

said set of chance tickets including a plurality of chance tickets each chance ticket having at least one symbol set which is hidden when distributed by a distributor and then opened by an end user to reveal the at least one symbol set, said at least one symbol set including at least one symbol that is indicative of a winning condition or a non-winning condition of the symbol set;

producing said set of chance tickets with advertising sections on individual chance tickets which vary from ticket to ticket with different advertisements from different advertisers.

6. A method according to claim 5 wherein said producing includes having the frequency of advertisements be variable by advertiser.

7. An apparatus forming a set of chance tickets, comprising:

wherein said set of chance tickets includes a plurality of chance tickets, each chance ticket having at least one indicia which is hidden when distributed by a distributor and then opened by an end user to reveal the at least one indicia, said at least one indicia being indicative of a winning condition or a non-winning condition of the at least one indicia;

said set of chance tickets includes plural individual chance tickets which include at least one advertising section thereon;

said at least one advertising section on multiple chance tickets of said set of chance tickets being different from other chance tickets of the same set so as to provide advertisements for a plurality of different advertisers at advertising frequencies that vary between advertisers.

8. An apparatus according to claim 7 and wherein the advertisement frequency of advertisements for each advertiser is variable by advertiser.

9. A system forming multiple groups of chance tickets, each group of chance tickets including at least one set of chance tickets, comprising:

wherein said set of chance tickets includes a plurality of chance tickets, each chance ticket having at least one indicia which is hidden when distributed by a distributor and then opened by an end user to reveal the at least one indicia, said at least one indicia being indicative of a winning condition or a non-winning condition;

said set of chance tickets including individual chance tickets which include at least one advertising section thereon;

said at least one advertising section on multiple chance tickets of said set of chance tickets being different from other chance tickets of the same set so as to provide advertisements for a plurality of different advertisers;

and wherein at least two groups of chance tickets are adapted to provide advertising which is directed to different markets.

10. An apparatus according to claim 9 and wherein the frequency of advertisements varies by advertiser.

11. A method for producing chance tickets comprising:

taking advertising orders from multiple advertisers who desire to have advertising sections included on chance tickets which form a set of chance tickets;

said set of chance tickets including a plurality of chance tickets each chance ticket having at least one indicia which is hidden when distributed by a distributor and then opened by an end user to reveal the at least one indicia, said at least one indicia being indicative of a winning condition or a non-winning condition;

producing said set of chance tickets with advertising sections on individual chance tickets which have different advertisements from said multiple advertisers on different chance tickets of said set of chance tickets.

12. A method according to claim 11 wherein said producing includes having the frequency of advertisements be variable by advertiser.

* * * * *